US006848634B1

(12) United States Patent
Imoehl

(10) Patent No.: US 6,848,634 B1
(45) Date of Patent: Feb. 1, 2005

(54) FUEL INJECTOR WITH THERMALLY ISOLATED SEAT

(75) Inventor: William James Imoehl, Williamsburg, VA (US)

(73) Assignee: Siemens VDO Automotive Corp., Auburn Hills, MI (US)

( * ) Notice: Subject to any disclaimer, the term of this patent is extended or adjusted under 35 U.S.C. 154(b) by 0 days.

(21) Appl. No.: 09/474,766

(22) Filed: Dec. 30, 1999

(51) Int. Cl.[7] ..... B05B 1/30
(52) U.S. Cl. ..... 239/533.12; 239/486
(58) Field of Search ..... 239/397.5, 585.1, 239/585.4, 585.5, 532.2, 533.3, 533.12, 486; 251/359, 363

(56) References Cited

U.S. PATENT DOCUMENTS

| | | | | | |
|---|---|---|---|---|---|
| 1,664,616 | A | * | 4/1928 | French | 239/585.5 |
| 4,434,766 | A | * | 3/1984 | Matsuoka et al. | 239/531 |
| 4,569,484 | A | * | 2/1986 | Phatak | 239/533.3 |
| 4,634,055 | A | * | 1/1987 | Hans et al. | 239/533.3 |
| 5,098,064 | A | * | 3/1992 | Daly et al. | 251/306 |
| 5,170,945 | A | * | 12/1992 | Daly et al. | 239/585.5 |
| 5,188,297 | A | * | 2/1993 | Asano | 239/585.1 |
| 5,330,100 | A | * | 7/1994 | Malinowski | 239/585.5 |
| 5,875,972 | A | * | 3/1999 | Ren et al. | 239/585.4 |
| 6,065,692 | A | * | 5/2000 | Brinn, Jr. | 239/533.12 |
| 6,068,495 | A | * | 5/2000 | Virchow | 439/125 |
| 6,142,395 | A | * | 11/2000 | Reiter | 239/585.5 |
| 6,145,761 | A | * | 11/2000 | Muller et al. | 239/585.5 |

FOREIGN PATENT DOCUMENTS

| | | | | |
|---|---|---|---|---|
| FR | 1 089 892 | A * | 3/1955 | F02M/53/64 |
| FR | 1 157 264 | A * | 5/1958 | F02M/61/12 |
| GB | 759 524 | A * | 10/1956 | F02M/61/20 |
| GB | 834826 | A * | 5/1960 | F02M/61/16 |

* cited by examiner

*Primary Examiner*—Christopher Kim

(57) ABSTRACT

A body and a seat for a fuel injector having a fuel inlet, a fuel outlet, and a fuel passageway extending from the fuel inlet to the fuel outlet along a longitudinal axis. The body includes an inlet portion, an outlet portion, and a neck portion disposed between the inlet portion and the outlet portion. The seat includes a first face, a second face, and a circumferential surface disposed between the first face and the second face. The circumferential surface includes a first zone and a second zone that are connected by an intermediate zone, the intermediate zone engaging the body and the second zone being thermally isolated from the body. A fuel injector and a method of forming a fuel injector are also disclosed.

14 Claims, 2 Drawing Sheets

FUEL INJECTOR WITH THERMALLY ISOLATED SEAT

BACKGROUND OF INVENTION

This invention relates to a fuel injector assembly, and more particularly to a high-pressure direct injection fuel injector assembly having a seat that is thermally isolated from a body exposed to extreme temperatures within an engine cylinder.

Experimental testing has shown that the extreme temperatures within an engine cylinder can effect the operative performance characteristics of the fuel injector assembly. First, the excessive temperatures of the engine cylinder can disproportionately distort the components of the fuel injector assembly within the engine cylinder. For example, the body, which is preferably metal, can be distorted an unequal quantity relative to a needle disposed within the body. Distorting of the components of the fuel injector disproportionally can, for example, alter the dimensional tolerances between the components of the fuel injector, i.e., the body, the needle, and the seat, which is believed, under certain operative conditions, to render the fuel injector inoperative. Second, the excess temperatures of the engine cylinder can cause the fuel injector to overheat and coke unburned fuel on the components of the fuel injector, i.e., the tip components of the fuel injector, such as, the seat at an outlet portion of the body. Coking of the fuel injector tip components can block the outlet of the fuel injector, which is believed to affect the fuel spray patterns of the fuel injector. Thus, distorting and coking of the fuel injector components utilized in a direct inject application is believed to diminish the performance capability of the fuel injector. A seat that is thermally isolated from a body of a fuel injector assembly, it is believed, will substantially avoid the above-discussed problems. Thus, an arrangement of a fuel injector assembly where the seat is substantially thermally isolated from the body (i.e.—the contact area between the seat and the body is minimized) is desirable.

SUMMARY OF THE INVENTION

The present invention provides a fuel injector having a fuel inlet, a fuel outlet, and a fuel passageway extending from the fuel inlet to the fuel outlet along a longitudinal axis, the fuel injector including a body, an armature adjacent the inlet portion of the body having an inlet portion, an outlet portion, and a neck portion disposed between the inlet portion and the outlet portion, a needle operatively connected to the armature, a seat proximate the needle, and a seal. The seat has a first face, a second face, and a circumferential surface disposed between the first face and the second face, the circumferential surface including a first zone and a second zone that are connected by an intermediate zone, the intermediate zone engaging the body. The seal is disposed between the second zone of the seat and the body that thermally isolates the second zone of the seat from the body.

The present invention also provides a body and a seat for a fuel injector having a fuel inlet, a fuel outlet, and a fuel passageway extending from the fuel inlet to the fuel outlet along a longitudinal axis. The body includes an inlet portion, an outlet portion, and a neck portion disposed between the inlet portion and the outlet portion. The seat includes a first face, a second face, and an circumferential surface disposed between the first face and the second face, the circumferential surface including a first zone and a second zone that are connected by an intermediate zone, the intermediate zone engaging the body and the second zone being thermally isolated from the body.

The present invention also provides a method of forming a fuel injector having a fuel inlet, a fuel outlet, a fuel passageway extending from the fuel inlet to the fuel outlet along a longitudinal axis, a body, and a seat. The body has an inlet portion, an outlet portion, and a neck portion disposed between the inlet portion and the outlet portion. The seat has a first face, a second face, and a circumferential surface disposed between the first face and the second face, the circumferential surface including a first zone and a second zone that are connected by an intermediate zone. The method includes the steps of engaging the intermediate zone of the seat with the body, and thermally isolating the second zone of the seat from the body.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
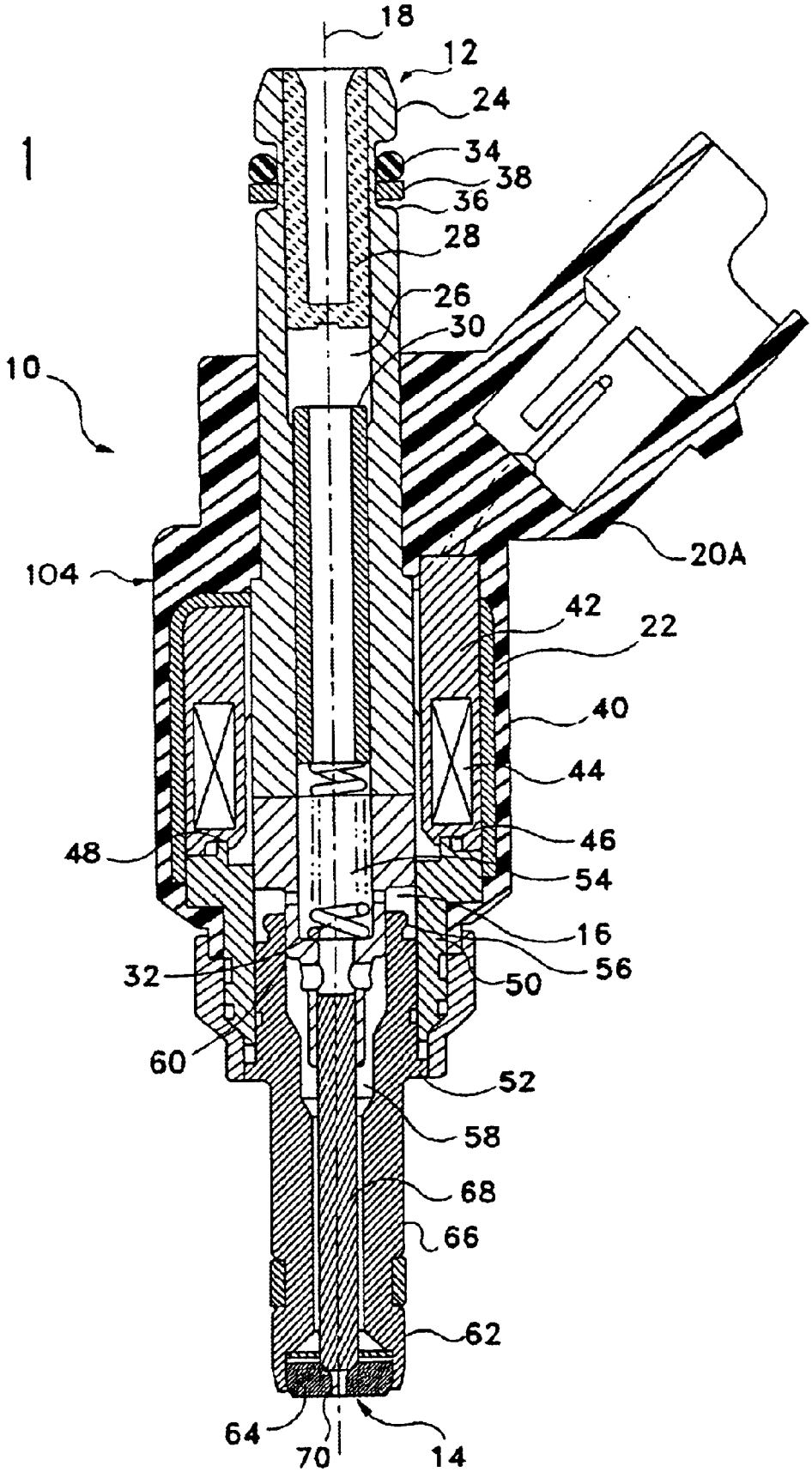
FIG. 1 is a cross-sectional view of a fuel injector assembly of the present invention taken along its longitudinal axis.

FIG. 1 illustrates a preferred embodiment of the fuel injector assembly 10, in particular a high-pressure, direct-injection fuel injector assembly 10. The fuel injector assembly 10 has a housing, which includes a fuel inlet 12, a fuel outlet 14, and a fuel passageway 16 extending from the fuel inlet to the fuel outlet 14 along a longitudinal axis 18. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 are provided in the inlet passage 26. The adjustable tube 30 is position-able along the longitudinal axis 18 before being secured in place to vary the length of an armature bias spring 32, which control the quantity of fluid flow within the injector. The overrmolded plastic member 20 also supports a socket that receives a plug (not shown) to operatively connect the fuel injector assembly 10 to an external source of electrical potential, such as an electronic control unit ECU (not shown). An elastomeric O-ring 34 is provided in a groove on an exterior extension of the inlet member. The O-ring 34 is biased by a flat spring 38 to sealingly secure the inlet source with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the socket through the overmolded plastic member 20. An armature 46 is axially aligned with the inlet member by structure to define a spacer 48 therein, a body shell 50, and a body 52. The armature 46 has an armature passage 54 aligned along the longitudinal axis 18 with the inlet passage 26 of the inlet member.

The spacer 48 engages the body 52, which is partially disposed within the body shell 50. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is axial aligned with the body passage 58 of the body 52 along the longitudinal axis 18. A seat 64, which is preferably a metallic material, is located at the outlet portion 62 of the body 52.

The body 52 has a neck portion 66, which is, preferably, a cylindrical annulus that surrounds a needle 68. The needle 68 is operatively connected to the armature 46, and is, preferably, a substantially cylindrical needle 68. The cylindrical needle 68 is centrally located within the cylindrical annulus. The cylindrical needle 68 is axially aligned with the longitudinal axis 18 of the fuel injector assembly 10.

Operative performance of the fuel injector assembly 10 is achieved by magnetically coupling the armature 46 to the inlet member near the inlet portion 60 of the body 52. A portion of the inlet member proximate the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector assembly 10. The electromagnetic force is generated by current flow from the ECU (not shown) through the coil assembly 40. Movement of the armature 46 also moves the operatively attached needle 68. The needle 68 engages the seat 64, which opens and closes the seat passage 70 of the seat 64 to permit or inhibit, respectively, fuel from exiting the fuel outlet 14 of the fuel injector 10. The needle 68 includes a curved surface 78, which is preferably a spherical surface, that mates with a conical end 80 of a funnel 82 that serves as the preferred seat passage 70 of the seat 64.

A swirl generator 76 is located in the body passage 58 proximate the seat 64. The swirl generator 76 allows the fuel to form a swirl pattern on the seat 64. In particular, for example, the fuel is swirled on the conical end 89 of the funnel 82 in order to produce a desired spray pattern. The swirl generator 76, preferably, is constructed from a pair of flat disks, a guide disk 78 and a swirl disk 80. The swirl generator 76 defines a contact area between the seat and the body 52. The guide disk 78 provides a support for the needle 68.

The needle 68 is guided in a central aperture of the guide disk 78. The guide disk 78 has a plurality of fuel passage openings that supply fuel from the body passage 58 to the swirl disk 80. The swirl disk 80 directs fuel from the fuel passage openings in the guide disk 78 and meters the flow of fuel tangentially toward the seat passage 70 of the seat 64. The guide disk 78 and swirl disks 80 that form the swirl generator 76 are secured to a first face 602 of the seat 64, preferably, by laser welding. During operation, fuel flows in fluid communication from the fuel inlet source (not shown) through the inlet passage 26 of the inlet member, the armature passage 54 of the armature 46, the body passage 58 of the body 52, the guide disk 78 and the swirl disk 80 of the swirl generator 76, and the seat passage 70 of the seat 64.

Figure 2:
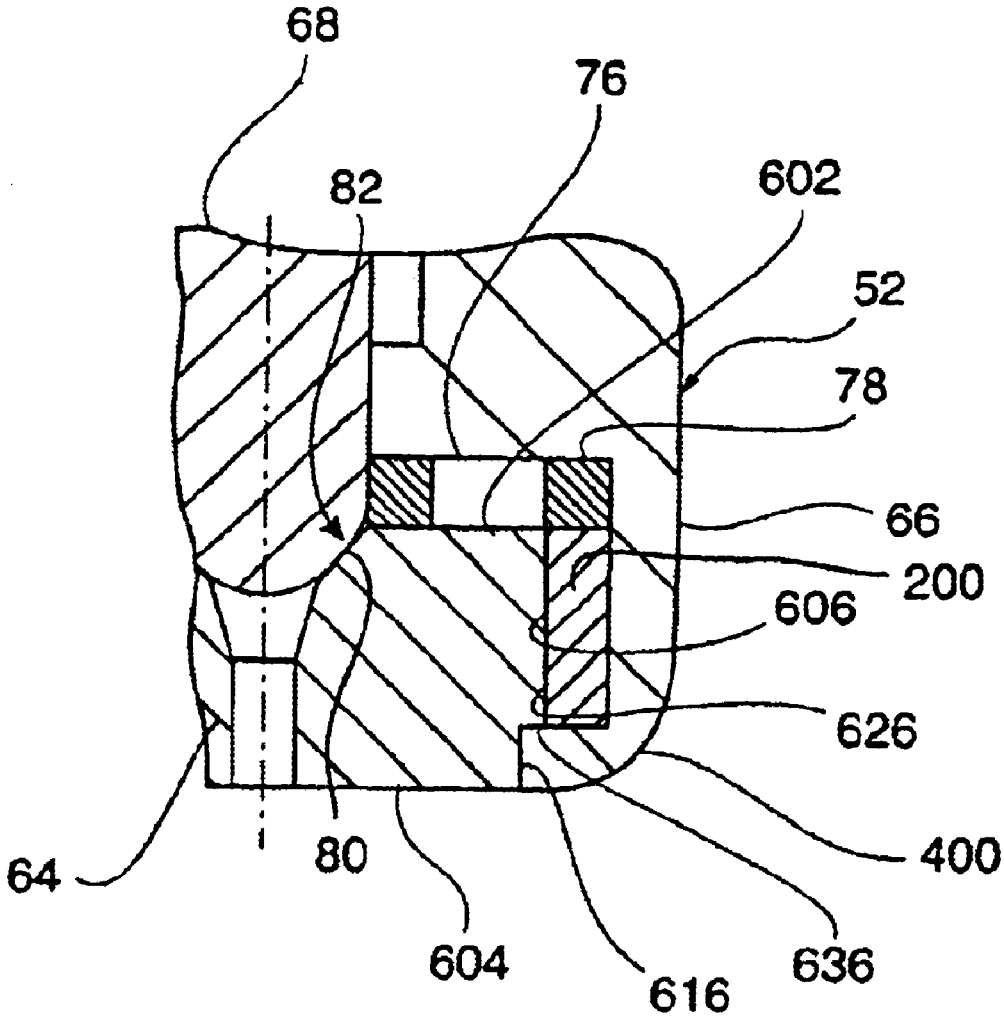
FIG. 2 is an enlarged portion of the cross-sectional view of the fuel injector assembly shown in FIG. 1, which illustrates the thermally isolated seat of the present invention.

FIG. 2 is an enlarged cross-sectional view of the fuel injector assembly shown in FIG. 1, which illustrates the thermally isolated seat of the present invention. The seat 64 includes the first face 602, a second face 604, and a circumferential surface 606 disposed between the first face 602 and the second face 604. The circumferential surface 606 includes a first zone 616 and a second zone 626. An annular intermediate zone 636 extends between and connects the first zone 616 to the second zone 626. The intermediate zone 636 engages the body 52 to define a first contact area between the body 52 and the seat 64. The second zone 626 of the circumferential surface 606 is thermally isolated from the body 52 as will be described below. Preferably, the first zone 616 is isolated against thermal conduction from the body 52 by a gap therebetween. Otherwise, the first contact area between the body 52 and the seat 64 is increased by the area of engagement between the first zone 616 and the body 52.

The body 52 includes a retention member 400. Preferably, the retention member is in the form of a crimped section of the neck portion 66 of the body 52 and is disposed at the outlet portion 62 of the body 52. The retention member 400 includes a surface that engages the intermediate zone 636 of the seat 64 to define a first contact area between the body 52 and the seat 64. The first contact area between the body 52 and the seat 64 substantially allows the conduction of thermal energy between the body 52 and the seat 64.

A seal 200 is disposed between the second zone 626 of the circumferential surface 606 of the seat 64 and the body 52. The seal 200 acts to thermally isolate the seat 64 from the body 52 of the fuel injector assembly 10. The seal 200 may be manufactured from a material that is a substantial thermal insulator. By this arrangement, the seal 200 substantially thermally isolates the second zone 626 of the seat 64 from the body 52. Preferably, the seal 200 comprises polytetrafluoroethylene.

In order to prevent the conduction of thermal energy from the body 52 to the seat 64, it is desirable to substantially minimize the first contact area between the body 52 and the seat 64. By this arrangement, a substantially larger portion of the seat 64 will be substantially thermally isolated from the body 52 by the seal 200. The swirl generator 76 also defines a contact area (second contact area) between the body 52 and the seat 62. Thus, it is desirable to substantially minimize the second contact area between the body 52 and the seat 64. The seal 200 substantially thermally isolates the seat 64 from the body 52 by preventing the conduction of heat from the body 52 to the seat 64.

A method of forming the fuel injector assembly 10 includes the steps of engaging the intermediate zone 636 of the seat 64 with the body 52, and thermally isolating the second zone 626 of the seat 65 from the body 52 by disposing the seal 200 therebetween. The seal 200 is formed of a material that is a substantial thermal insulator. Preferably, the seal comprises polytetrafluoroethylene. The intermediate zone 636 of the seat 64 is retained with a retention member 400 having a surface that engages the intermediate zone 636 of the seat 64 to define a first contact area between the body 52 and the seat 64. Preferably, the retention member is in the form of a crimped section of the neck portion 66 of the body 52 and is disposed at the outlet portion 62 of the body 52. The first contact area between the body 52 and the seat 64 substantially allows the conduction of thermal energy between the body 52 and the seat 64.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector having a fuel inlet, a fuel outlet, and a fuel passageway extending from the fuel inlet to the fuel outlet along a longitudinal axis, the fuel injector comprising:

a body having an inlet portion, an outlet portion, and a neck portion disposed between the inlet portion and the outlet portion, the neck portion having a surface defining a portion of the fuel passageway;

an armature adjacent the inlet portion of the body;

a needle operatively connected to the armature;

a seat defining a funnel having a conical end disposed within the body, the conical end engaging the needle to form a seal in a first position of the needle, the seat proximate the needle and having a first face, a second face, and a circumferential surface disposed between the first face and the second face, the circumferential surface including a first zone and a second zone that are connected by an intermediate zone extending substantially perpendicular to the first and second zones, the intermediate zone contiguously engaging an inner surface of the neck portion of the body, the inner surface being located between the conical end of the funnel and the fuel outlet;

a seal disposed between the second zone of the seat and the body so that the seal thermally isolates the second zone of the seat from the body; and a swirl generator disposed proximate the seat, the swirl generator being contiguous with the seal.

2. The fuel injector according to claim 1, wherein the body includes a retention member that engages the intermediate zone of the seat.

3. The fuel injector according to claim 2, wherein the retention member includes the inner surface that engages the intermediate zone of the seat to define a first contact area between the body and the seat.

4. The fuel injector according to claim 3, wherein the retention member comprises a crimped section on the neck portion and is disposed at the outlet portion of the body.

5. The fuel injector according to claim 1, wherein the seal comprises polytetrafluoroethylene.

6. A body and a seat for a fuel injector having a fuel inlet, a fuel outlet, and a fuel passageway extending from the fuel inlet to the fuel outlet along a longitudinal axis, the body and the seat comprising:

a body having an inlet portion, an outlet portion, and a neck portion disposed between the inlet portion and the outlet portion, the neck portion having a surface defining a portion of the fuel passageway; and a seat defining a funnel, the funnel having a conical end disposed within the body, the seat having a fist face, a second face, and an circumferential surface disposed between the first face and the second face, the circumferential surface including a first zone and a second zone that are connected by an intermedia zone extending substantially perpendicular to the first and second zones, the intermediate zone contiguously engaging an inner surface of the neck portion of the body, and the second zone being thermally isolated from the body, the inner surface being located between the conical end of the funnel and the fuel outlet; and a swirl generator disposed proximate the seat, the swirl generator having a portion contiguous the neck portion of the body and one of the first and second faces.

7. The body and the seat according to claim 6, wherein the body includes a retention member having the inner surface engaging the intermediate zone of the seat, the inner surface of the retention member defining a first contact area between the body and the seat.

8. The body and seat according to claim 6, further comprising:

a seal disposed between the second zone of the seat and the body, the seal thermally isolating the seat from the body.

9. A method of forming a fuel injector having a fuel inlet, a fuel outlet, a fuel passageway extending from the fuel inlet to the fuel outlet along a longitudinal axis, a body having an inlet portion, an outlet portion, and a neck portion disposed between the inlet portion and the outlet portion, the neck portion having a surface defining a portion of the fuel passageway, and a seat defining a funnel, the funnel having a conical end, the seat having a first face, a second face, and a circumferential surface disposed between the first face and the second face, the circumferential surface including a first zone and a second zone that are connected by an intermediate zone extending substantially perpendicular to the first and second zones, the method comprising:

contiguously engaging the intermediate zone of the seat with an inner surface of the neck portion of the body, the inner surface being located between the conical end of the funnel and the fuel outlet; and thermally isolating the second zone of the seat from the body with a seal contiguous to a swirl generator disposed proximate the conical end of the funnel.

10. The method according to claim 9, further comprising:

disposing a seal between the second zone of the seat and the body to thermally isolate the seat from the body.

11. The method according to claim 9, further comprising:

retaining the intermediate zone of the seat and the body with a retention member.

12. The method according to claim 11, wherein the contiguously engaging comprises defining a first contact area between the body and the seat.

13. The method according to claim 12, wherein the retaining includes crimping a section on the neck portion that is disposed at the outlet portion of the body.

14. The method according to claim 9, wherein the disposing comprises a polytetrafluoroethylene seal.

* * * * *